US010118079B1

(12) United States Patent
Hayes

(10) Patent No.: US 10,118,079 B1
(45) Date of Patent: Nov. 6, 2018

(54) PUTTER HEAD SWINGING ASSEMBLY

(71) Applicant: Ronald Hayes, Los Angeles, CA (US)

(72) Inventor: Ronald Hayes, Los Angeles, CA (US)

( * ) Notice: Subject to any disclaimer, the term of this patent is extended or adjusted under 35 U.S.C. 154(b) by 0 days.

(21) Appl. No.: 15/729,371

(22) Filed: Oct. 10, 2017

(51) Int. Cl.

| | |
|---|---|
| ***A63B 67/02*** | (2006.01) |
| ***A63B 69/36*** | (2006.01) |
| *A63B 71/06* | (2006.01) |
| *A63F 7/24* | (2006.01) |
| *A63F 7/06* | (2006.01) |

(52) U.S. Cl.
CPC ..... *A63B 67/02* (2013.01); *A63B 69/3661* (2013.01); *A63B 69/3676* (2013.01); *A63B 2071/0694* (2013.01); *A63B 2209/00* (2013.01); *A63F 7/0628* (2013.01); *A63F 7/2472* (2013.01)

(58) Field of Classification Search
CPC ..... A63F 7/0628; A63F 7/2472
USPC ..... 273/108.2, 108.21
See application file for complete search history.

(56) References Cited

U.S. PATENT DOCUMENTS 675,456 A * 6/1901 Vorhees ..... A63F 7/0628 273/108.2
731,825 A * 6/1903 Vorhees ..... A63F 7/2472 273/108.22
1,136,465 A * 4/1915 Clark, Jr. ..... A63F 7/2472 273/108.22
1,173,818 A * 2/1916 Lins ..... A63F 7/0628 273/108.2
1,429,656 A * 9/1922 Stonebridge ..... A63B 65/12 273/108.2
1,493,934 A * 5/1924 Grau ..... A63F 7/0628 273/317.2
1,561,178 A * 11/1925 McGrann ..... A63F 7/0628 101/407.1
2,513,198 A * 6/1950 Munro ..... A63F 7/2472 273/108.22
2,641,933 A 6/1953 Van Kinkle
2,785,899 A * 3/1957 Burke ..... A63F 7/2472 273/317.2
2,793,037 A * 5/1957 Smith ..... A63F 7/2472 273/108.2
3,179,413 A * 4/1965 Lecierc ..... A63F 7/2472 273/108.22
4,058,313 A * 11/1977 Spradlin ..... A63F 7/0628 273/108.22
4,239,217 A * 12/1980 Thieme ..... A63F 7/0628 273/108.22

(Continued)

FOREIGN PATENT DOCUMENTS

WO WO2007037804 4/2007

*Primary Examiner* — Mark Graham

(57) ABSTRACT

A putter head swinging assembly for striking a golf ball includes a ball striking assembly that strikes a golf ball. A mat has a top side and a well that extends therein. The golf ball striking assembly is positioned on the top side. The golf ball striking assembly includes a stand has a top end and a bottom end. The bottom end defines a flat base. The stand has an aperture that extends therethrough. A shaft that has a first end and a second end extends through the aperture. A swing arm is attached to the first end and extends downwardly therefrom. A putter head is attached to a bottom of the swing arm such that when the shaft is rotated in a first direction the swing arm swings in the first direction and when released the swing arm moves in a second direction and strikes the golf ball.

15 Claims, 7 Drawing Sheets

(56) References Cited

U.S. PATENT DOCUMENTS

| | | | | | |
|---|---|---|---|---|---|
| 4,511,142 | A * | 4/1985 | Pote, Jr. | A63F 7/0628 | 273/108.22 |
| D283,716 | S * | 5/1986 | Seidel | D21/319 | |
| 4,949,973 | A | 8/1990 | Williamson | | |
| 5,417,420 | A * | 5/1995 | Berg | A63F 7/0628 | 273/108.2 |
| 5,989,129 | A | 11/1999 | O'Neil | | |
| 6,364,784 | B1 | 4/2002 | Fuhre | | |
| 6,551,194 | B2 | 4/2003 | Hammerquist | | |
| 7,364,164 | B2 * | 4/2008 | Anasis | A63F 7/0628 | 273/108.22 |
| 7,594,858 | B2 | 9/2009 | Hauk | | |
| 2011/0300966 | A1 * | 12/2011 | Gill | A63B 53/14 | 473/299 |
| 2013/0106057 | A1 * | 5/2013 | Perry, Jr. | A63B 67/02 | 273/317 |

* cited by examiner

PUTTER HEAD SWINGING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to ball striking devices and more particularly pertains to a new ball striking device for striking a golf ball.

BRIEF SUMMARY OF THE INVENTION

An embodiment of the disclosure meets the needs presented above by generally comprising a ball striking assembly and a golf ball. The golf ball striking assembly is configured to strike the golf ball during game play. A mat is provided that has a top side and a well that extends therein. The ball striking assembly is positioned on the top side. The golf ball striking assembly includes a stand has a top end and a bottom end. The bottom end defines a flat base. The stand has an aperture that extends therethrough. A shaft has a first end and a second end. The shaft extends through the aperture. A swing arm is attached to the first end and extends downwardly therefrom. A putter head is attached to a bottom of the swing arm such that when the shaft is rotated in a first direction the swing arm swings in the first direction and when released the swing arm moves in a second direction and strikes the golf ball.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
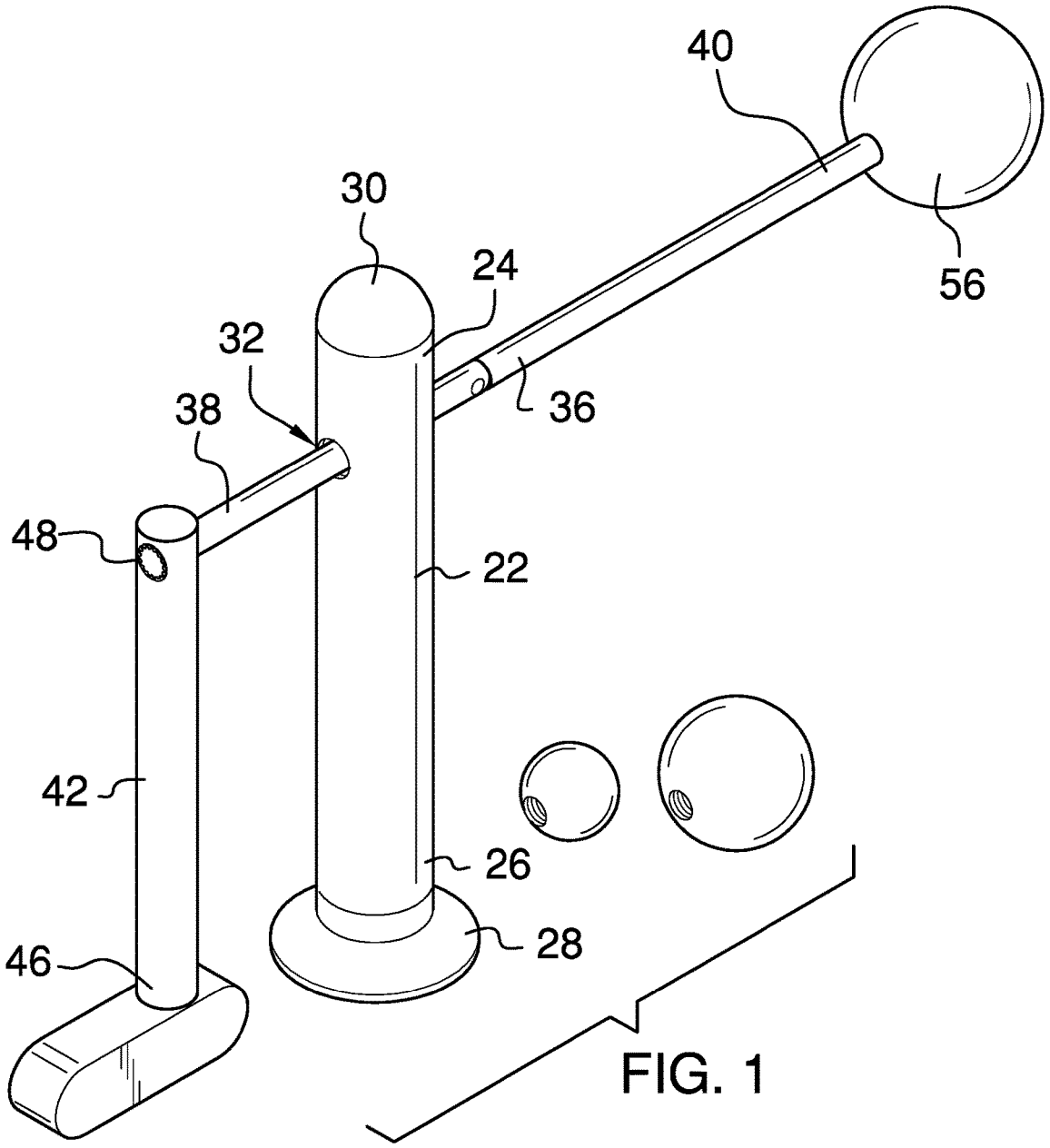
FIG. 1 is a top side view of a putter head swinging assembly according to an embodiment of the disclosure.
Figure 2:
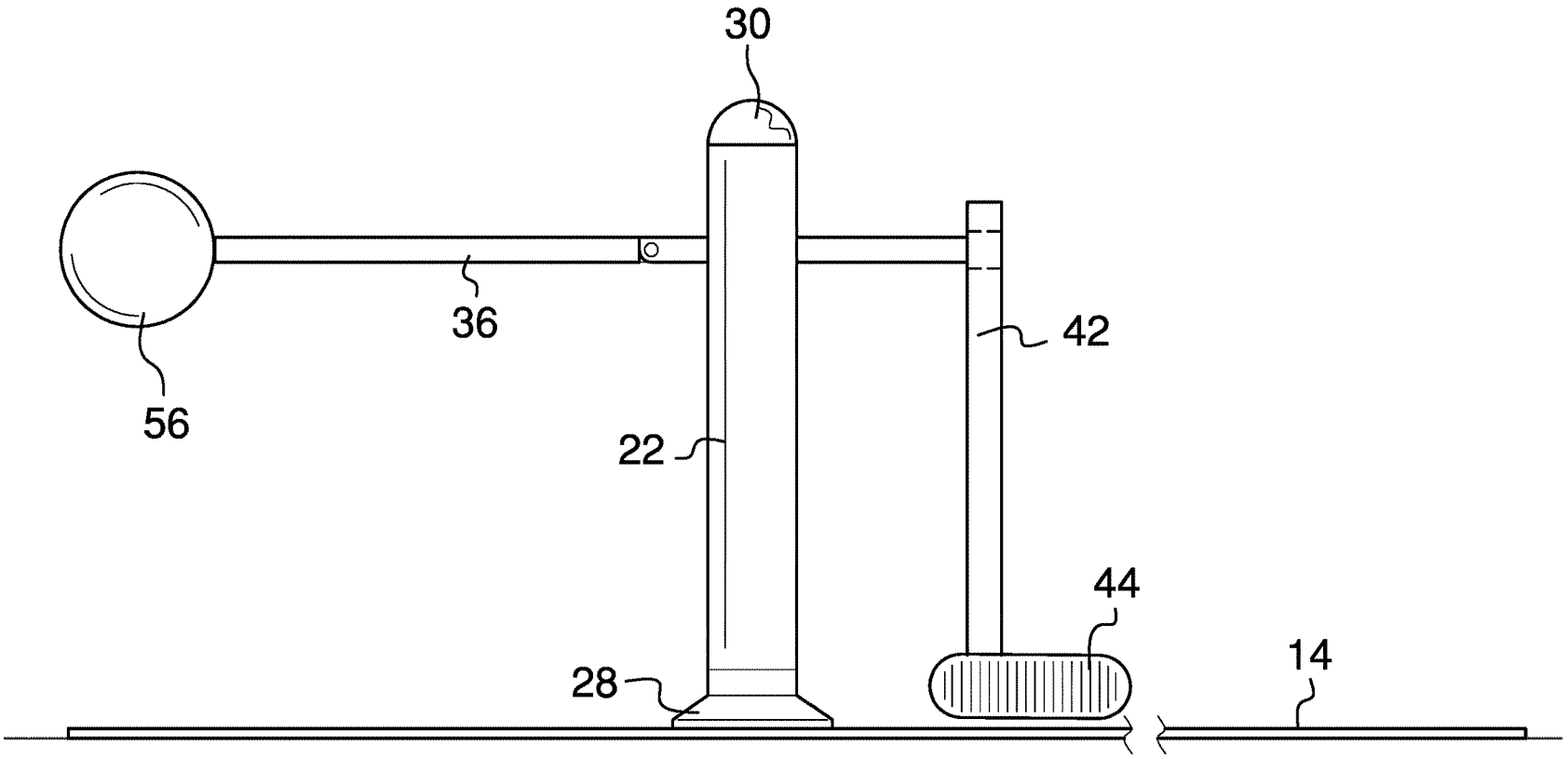
FIG. 2 is a back view of an embodiment of the disclosure.
Figure 3:
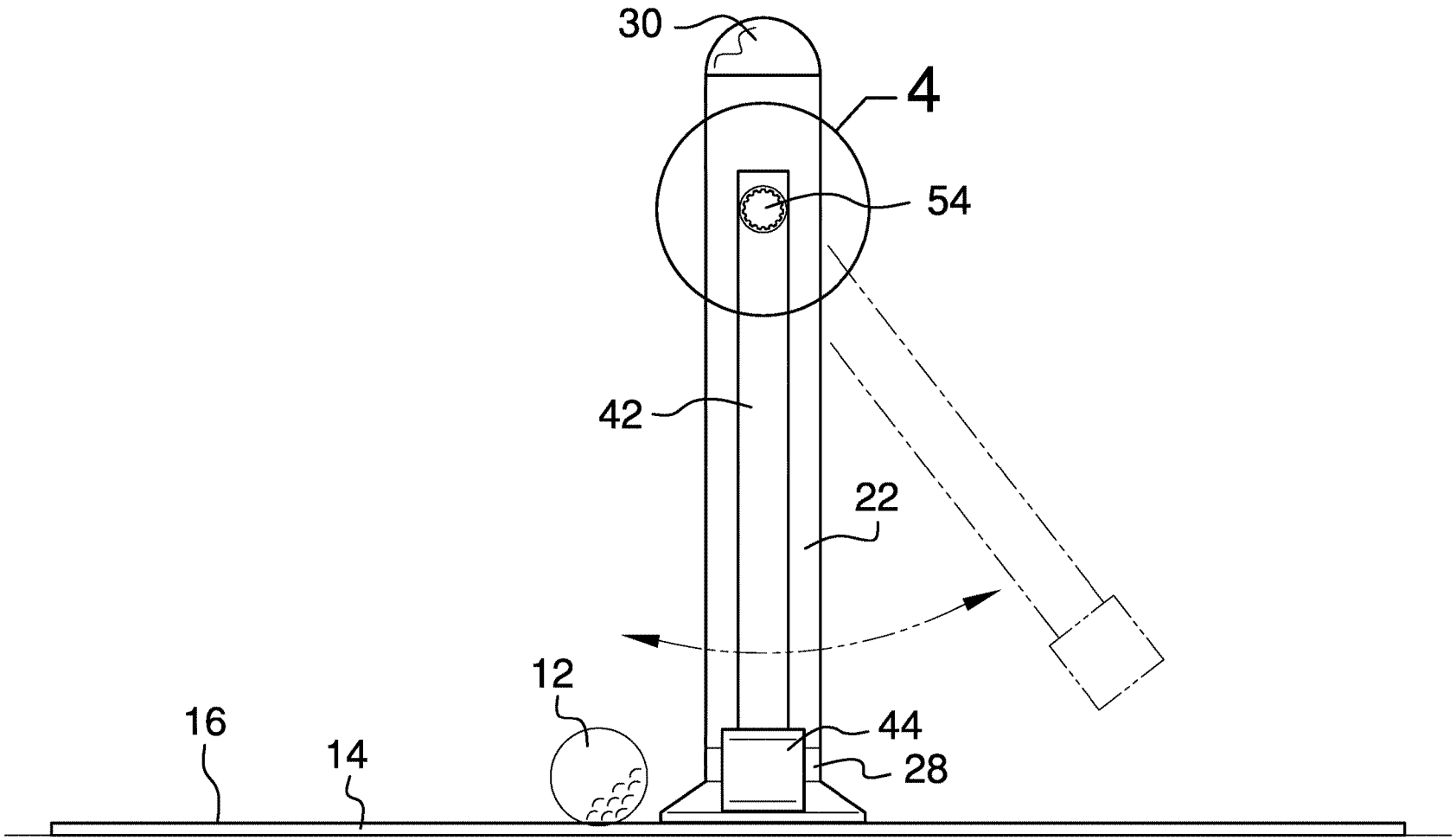
FIG. 3 is a side view of an embodiment of the disclosure.
Figure 4:
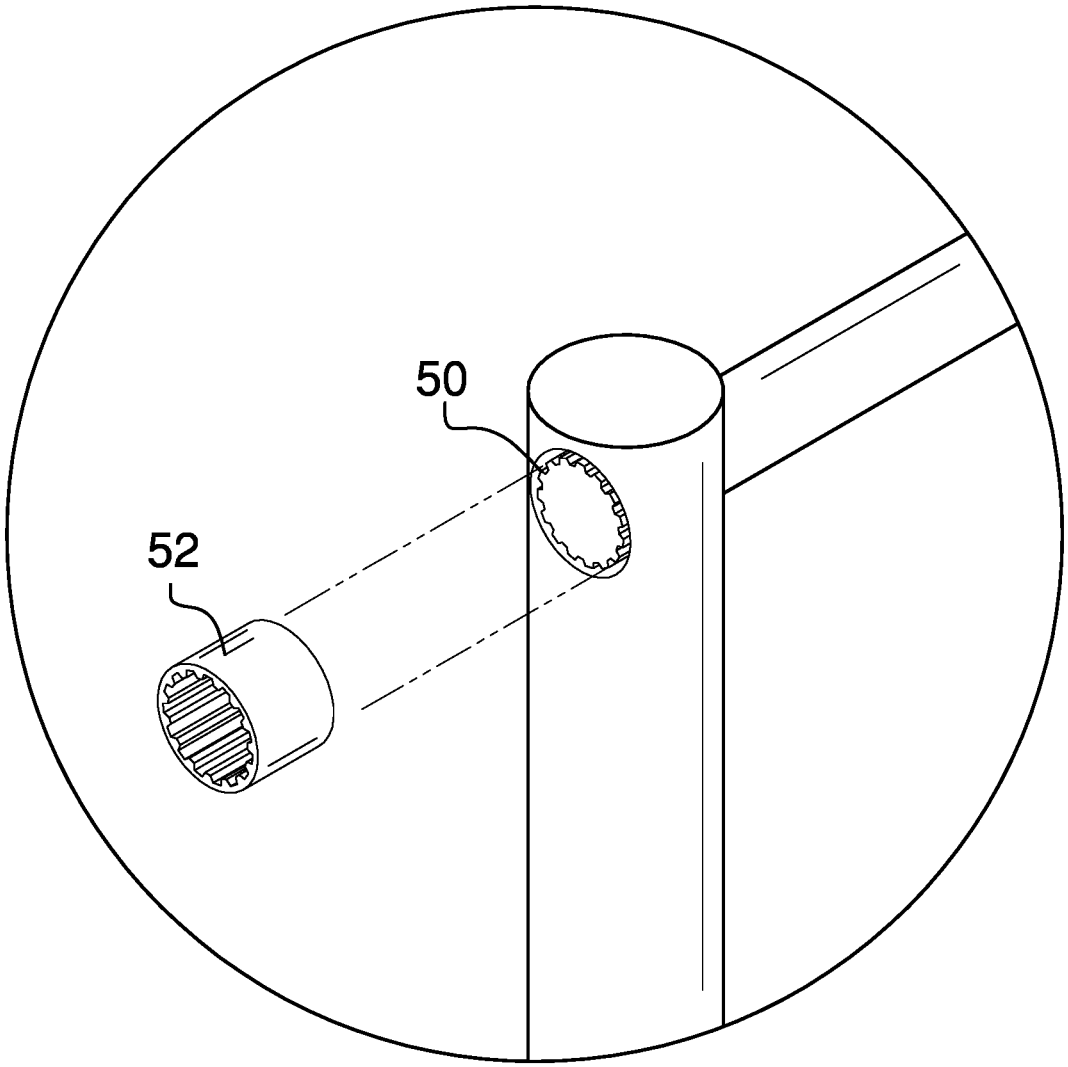
FIG. 4 is an enlarged top side view of a shaft and swing arm of the disclosure designated as "4" in FIG. 3.
Figure 5:
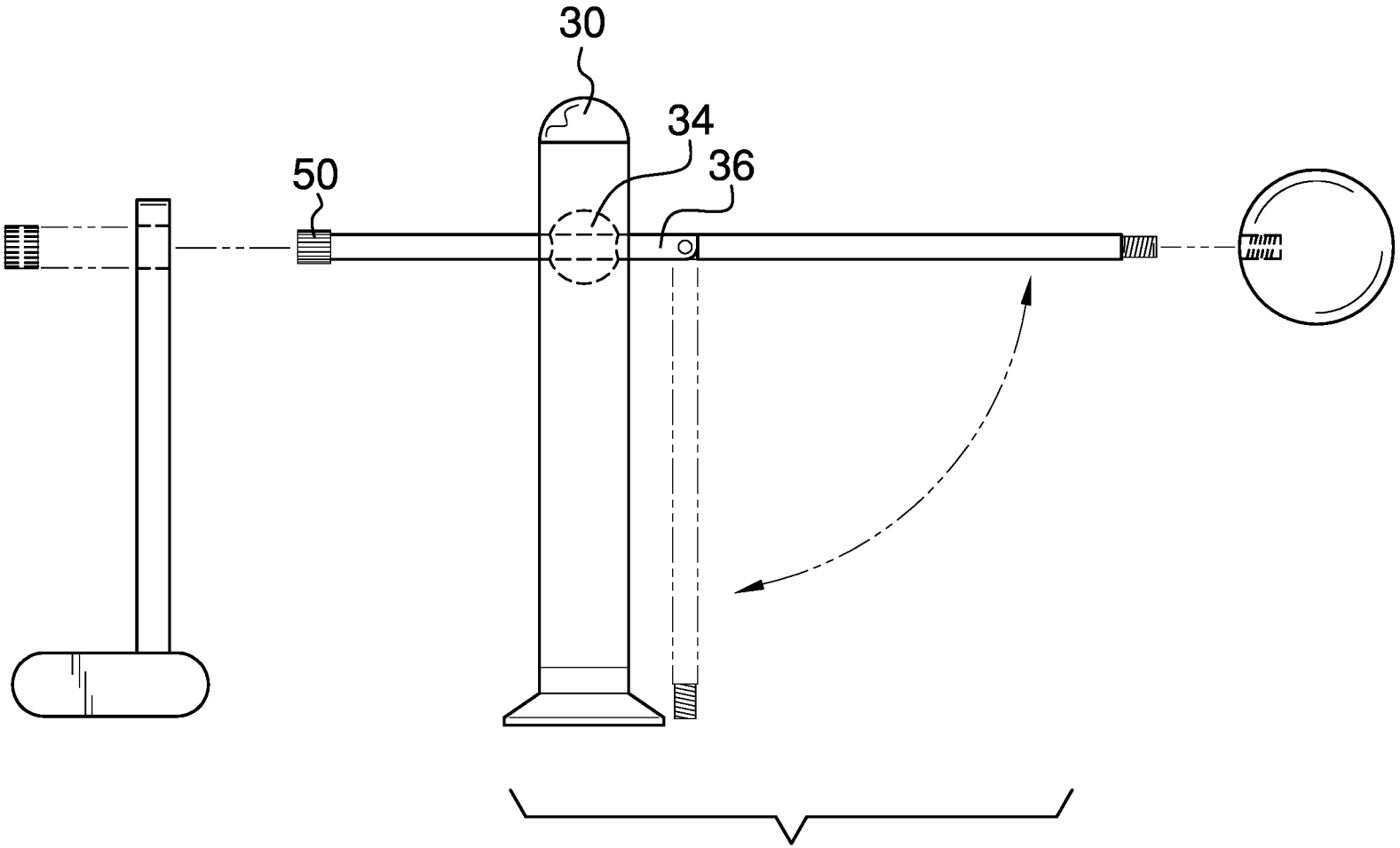
FIG. 5 is a front view of an embodiment of the disclosure.
Figure 6:
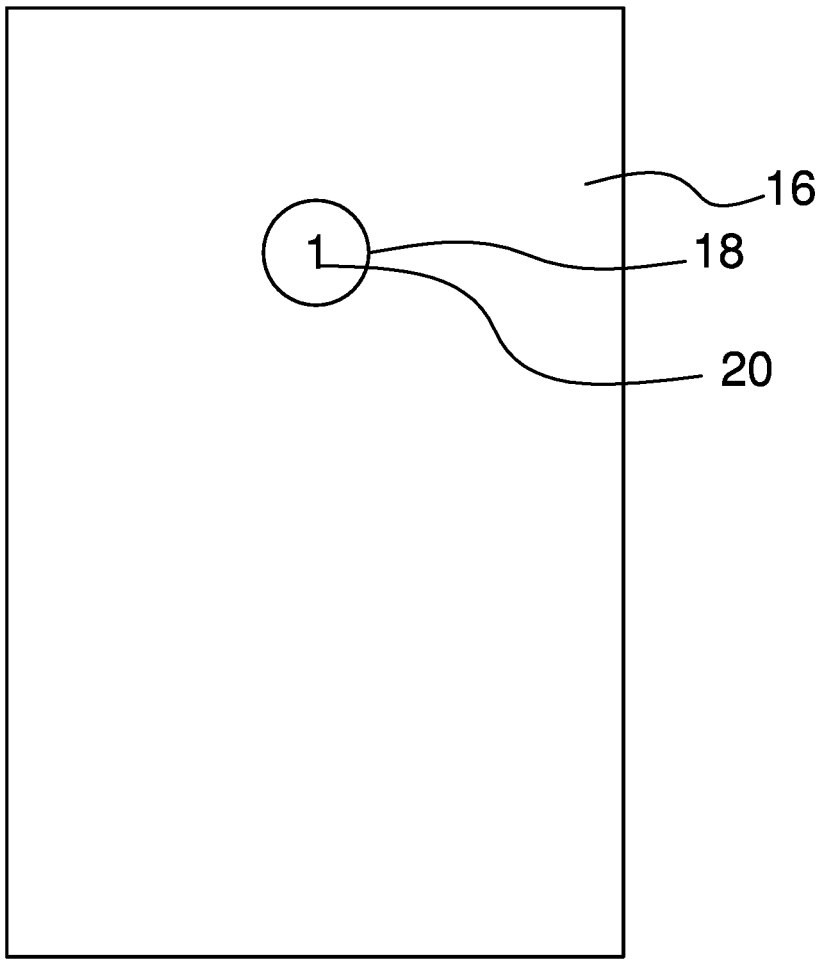
FIG. 6 is a top view of an embodiment of the disclosure.
Figure 7:
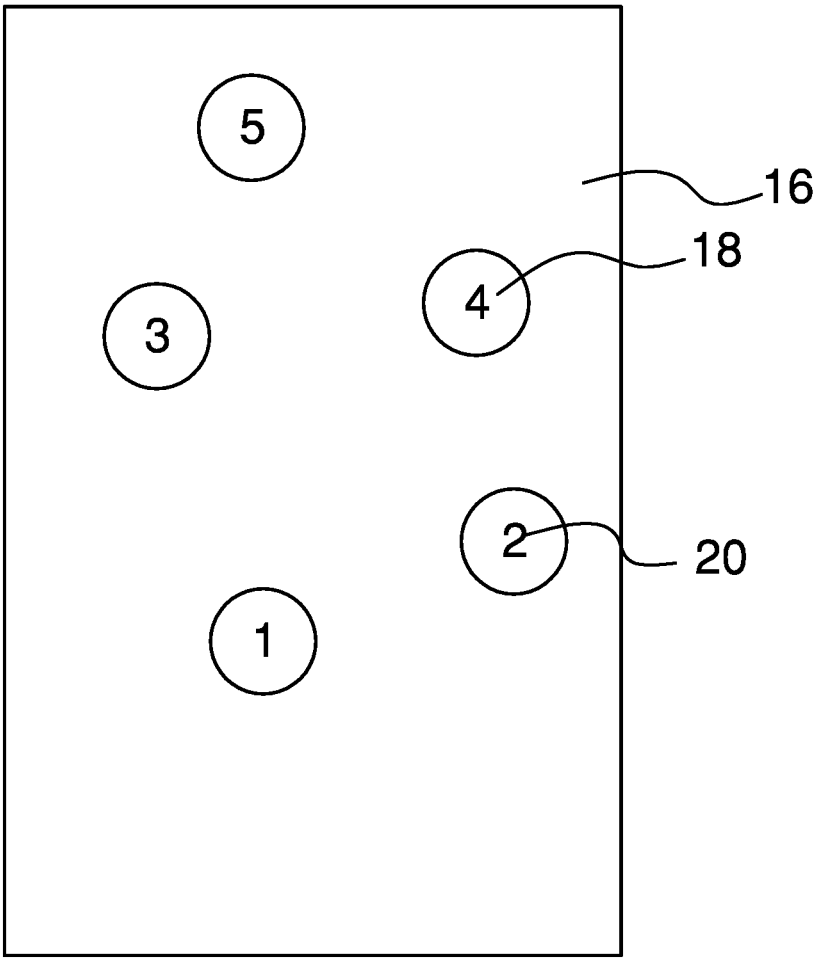
FIG. 7 is a top view of an embodiment of the disclosure.

With reference now to the drawings, and in particular to FIGS. 1 through 7 thereof, a new ball striking device embodying the principles and concepts of an embodiment of the disclosure and generally designated by the reference numeral 10 will be described.

As best illustrated in FIGS. 1 through 7, the putter head swinging assembly 10 generally comprises a ball striking assembly and a golf ball 12. The golf ball striking assembly strikes the golf ball 12. A mat 14 is included and has a top side 16 and a well 18 that extends therein. A score indicia 20 is associated with the well 18 is positioned on the top side 16. The mat 14 may have multiple wells 18 therein and score indicia 20 associated with each of the wells 18. The putter assembly is positioned on the top side 16. The top side 16 may be comprised of a plastic material, rubber material, a felt material or any other suitable material to exert friction on a golf ball. If the plastic material comprises synthetic grass, the synthetic grass will typically have a height equal or less than 1.0 inch.

The ball striking assembly includes a stand 22 that has a top end 24 and a bottom end 26. The bottom end 26 defines a flat base 28. The flat base 28 is configured to retain the stand 22 in a perpendicular orientation with respect to the mat 14. A finger rest 30 is positioned on the top end 24 such that a finger may be positioned on the finger rest 30 to secure the stand 22 in an upright orientation. The stand 22 has an aperture 32 that extends therethrough and is orientated perpendicular to a vertical axis of the stand 22. A ball bearing 34 is positioned within the aperture 32.

A shaft 36 includes a first end 38 and a second end 40. The shaft 36 extends through the aperture 32. The ball bearing 34 engages the shaft 36 and facilitates the rotation of the shaft 36 along its longitudinal axis with respect to the stand 22.

A swing arm 42 is attached to the first end 38 and extends downwardly therefrom. A putter head 44 is attached to a bottom end 46 of the swing arm 42 such that when the shaft 36 is rotated in a first direction the swing arm 42 swings in the first direction and when released the swing arm 42 moves in a second direction to strike the golf ball 12. The swing arm 42 has a height from the bottom end 46 to the shaft 36 that is less than 6.0 inches. The putter head 44 has a bottom edge is positioned above and vertically spaced from the bottom end of the stand a distance of less than 0.50 inches.

A coupler 48 releasably couples the first end 38 of the shaft to the swing arm 42. The coupler 48 includes a first mating member 50 that is attached to the first end 38 of the shaft. A second mating member 52 is mounted to the swing arm 42 distal to the putter head 44. A ratchet gear 54 is mounted in the swing arm 42 and is mechanically coupled to the second mating member 52. The ratchet gear 54 allows the second mating member 52 to rotate only in the second direction.

A plurality of grips 56 is provided and each of the grips 54 has a different weight with respect to each other. Each of the grips 54 is removably attachable to the second end 40 of the shaft 36. Each of the grips 54 has a spherical shape and a diameter less than 3.0 inches. Depending on the weight of the grip 56 used, the putter head 44 will travel faster or slower as it overcomes the mass of the grip 56.

In use, the mat 14 is placed on a flat surface 58. The flat base 28 is positioned on the mat 14 facing towards a well 18 in the mat 14. The shaft 36 is positioned the through aperture 32 and the swing arm 42 is attached to the shaft 36. A grip 56 is selected and attached to the shaft 36. A golf ball 12 is placed in front of the putter head 44. The user places their finger on the finger rest 30 to secure the stand 22 in an upright orientation. The grip 56 is then twisted backward away from the golf ball 12 and released wherein the putter head 44 swings forward and strikes the golf ball 12 toward a well 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf ball putting assembly used to putt a golf ball into a hole, said assembly comprising:

a ball striking assembly;

a golf ball, said golf ball striking assembly being configured to strike said golf ball;

a mat having a top side having a well extending therein, said ball striking assembly being positioned on said top side;

said ball striking assembly including:

a stand having a top end and a bottom end said bottom end defining a flat base, said stand having an aperture extending therethrough;

a shaft having a first end and a second end, said shaft extending through said aperture;

a swing arm being attached to said first end and extending downwardly therefrom, a putter head being attached to a bottom of said swing arm such that when said shaft is rotated in a first direction said swing arm swings in said first direction and when released said swing arm moves in a second direction striking said golf ball; and a coupler releasably coupling said swing arm to said shaft, said coupler including a first mating member attached to said first end of said shaft, a second mating member being mounted to said swing arm distal to said putter head, a ratchet gear being mounted in said swing arm and being mechanically coupled to said second mating member, said ratchet gear allowing said second mating member to rotate only in said second direction.

2. The golf ball putting assembly according to claim 1, wherein said mat has a score indicia being associated with said well being positioned on said top side.

3. The golf ball putting assembly according to claim 1, wherein said flat base is configured to retain said stand in a perpendicular orientation with respect to said mat.

4. The golf ball putting assembly according to claim 1, wherein a finger rest is positioned on said top end such that a finger may be positioned on said finger rest to secure said stand in an upright orientation.

5. The golf ball putting assembly according to claim 1, wherein said aperture is orientated perpendicular to a vertical axis of said stand.

6. The golf ball putting assembly according to claim 5, further including a ball bearing being positioned within said aperture.

7. The golf ball putting assembly according to claim 6, wherein said ball bearing engages said shaft and facilitates rotation of said shaft about its longitudinal axis with respect to said stand.

8. The golf ball putting assembly according to claim 1, wherein said swing arm has a height from said bottom end to said shaft being less than 6.0 inches.

9. The golf ball putting assembly according to claim 8, wherein said putter head has a bottom edge being positioned above and vertically spaced from said bottom end of said stand a distance of less than 0.50 inches.

10. The golf ball putting assembly according to claim 1, further including a plurality of grips, each of said grips being removably attachable to said second end of said shaft.

11. The golf ball putting assembly according to claim 10, wherein each of said grips has a different weight.

12. The golf ball putting assembly according to claim 11, wherein each of said grips has a spherical shape having a diameter being less than 3.0 inches.

13. A golf ball putting assembly used to putt a golf ball into a hole, said assembly comprising:

a ball striking assembly;

a golf ball, said golf ball striking assembly being configured to strike said golf ball;

said ball striking assembly including:

a stand having a top end and a bottom end said bottom end defining a flat base, said stand having an aperture extending therethrough and being orientated perpendicular to a vertical axis of said stand;

a shaft having a first end and a second end, said shaft extending through said aperture;

a swing arm being attached to said first end and extending downwardly therefrom, a putter head being attached to a bottom of said swing arm such that when said shaft is rotated in a first direction said swing arm swings in said first direction and when released said swing arm moves in a second direction striking a golf ball; and wherein a coupler releasably couples said swing arm to said shaft, said coupler including a first mating member attached to said first end of said shaft, a second mating member being mounted to said swing arm distal to said putter head, a ratchet gear being mounted in said swing arm and being mechanically coupled to said second mating member, said ratchet gear allowing said second mating member to rotate only in said second direction.

14. The golf ball putting assembly according to claim 13, further including a plurality of grips, each of said grips having a different weight, each of said grips being removably attachable to said second end of said shaft, each of said grips having a spherical shape and having a diameter being less than 3.0 inches.

15. A golf ball putting assembly used to putt a golf ball into a hole, said assembly comprising:

a ball striking assembly;

a golf ball, said golf ball striking assembly being configured to strike said golf ball;

a mat having a top side having a well extending therein, a score indicia being associated with said well being positioned on said top side, said putter assembly being positioned on said top side;

said ball striking assembly including:

a stand having a top end and a bottom end said bottom end defining a flat base, said flat base being configured to retain said stand in a perpendicular orientation with respect to said mat, a finger rest being positioned on said top end such that a finger may be positioned on said finger rest to secure said stand in an upright orientation, said stand having an aperture extending therethrough and being orientated perpendicular to a vertical axis of said stand;

a ball bearing being positioned within said aperture;

a shaft having a first end and a second end, said shaft extending through said aperture, said ball bearing engaging said shaft and facilitating rotation of said shaft along its longitudinal axis with respect to said stand;

a swing arm being attached to said first end and extending downwardly therefrom, a putter head being attached to a bottom of said swing arm such that when said shaft is rotated in a first direction said swing arm swings in said first direction and when released said swing arm moves in a second direction striking a golf ball, said swing arm having a height from said bottom end to said shaft being less than 6.0 inches, said putter head having a bottom edge being positioned above and vertically spaced from said bottom end of said stand a distance of less than 0.50 inches;

a coupler releasably coupling said swing arm to said shaft, said coupler including:

a first mating member attached to said first end of said shaft;

a second mating member being mounted to said swing arm distal to said putter head;

a ratchet gear being mounted in said swing arm and being mechanically coupled to said second mating member, said ratchet gear allowing said second mating member to rotate only in said second direction; and a plurality of grips, each of said grips having a different weight, each of said grips being removably attachable to said second end of said shaft, each of said grips having a spherical shape and having a diameter being less than 3.0 inches.

* * * * *